United States Patent [19]

Prosen

[11] 4,092,966

[45] June 6, 1978

[54] FUEL VAPORIZING AND MIXING DEVICE FOR GASOLINE ENGINES

[75] Inventor: Gildo Prosen, Chicago, Ill.

[73] Assignee: Vortac, Inc., Glenview, Ill.

[21] Appl. No.: 738,623

[22] Filed: Nov. 3, 1976

[51] Int. Cl.[2] ..... F02M 29/06

[52] U.S. Cl. ..... 123/141; 48/180 R; 261/79 R

[58] Field of Search ..... 123/141; 48/180 R, 180 S, 48/180 C; 261/78 R, 79 R

[56] References Cited

U.S. PATENT DOCUMENTS

| | | | |
|---|---|---|---|
| 1,300,015 | 4/1919 | Reed | 123/141 X |
| 2,017,043 | 10/1935 | Galliot | 123/141 |
| 2,072,353 | 3/1937 | Ball | 123/141 |
| 3,437,467 | 4/1969 | Jacobus | 123/141 X |
| 3,564,580 | 2/1971 | Cinque | 123/141 X |
| 3,735,744 | 5/1973 | Brudy et al. | 123/141 |
| 3,815,565 | 6/1974 | Stelter | 123/141 |

FOREIGN PATENT DOCUMENTS

| | | | |
|---|---|---|---|
| 1,019,861 | 11/1957 | Germany | 123/141 |
| 600,079 | 11/1959 | Italy | 123/141 |

*Primary Examiner*—Charles J. Myhre
*Assistant Examiner*—Ira S. Lazarus
*Attorney, Agent, or Firm*—Hill, Gross, Simpson, Van Santen, Steadman, Chiara & Simpson

[57] ABSTRACT

A carburetor attachment for easy insertion between a carburetor and a cooperable engine intake manifold, adapted to promote intermixing and efficient vaporization in the air-gas mixture to provide increased gas mileage per gallon of fuel and decreased pollution emission in the engine exhaust, the device including a sleeve-like structure having internal lands and grooves adapted to provide a swirling, intermixing action in the air-gas mixture entering such an engine intake manifold.

4 Claims, 4 Drawing Figures

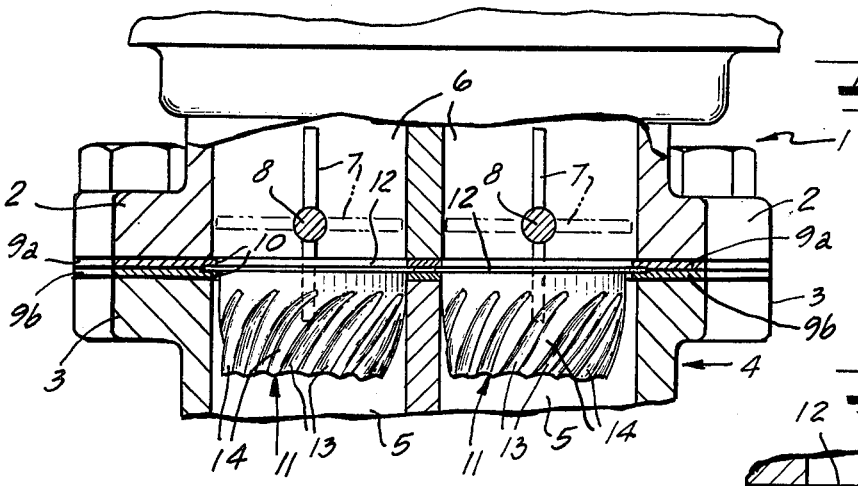
Fig. 1
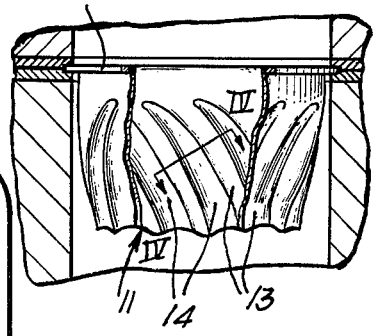
Fig. 3
Fig. 5
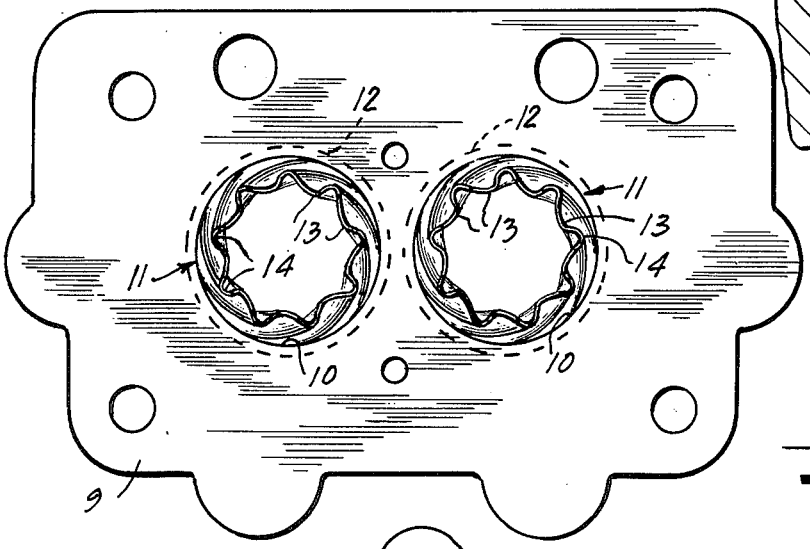
Fig. 2
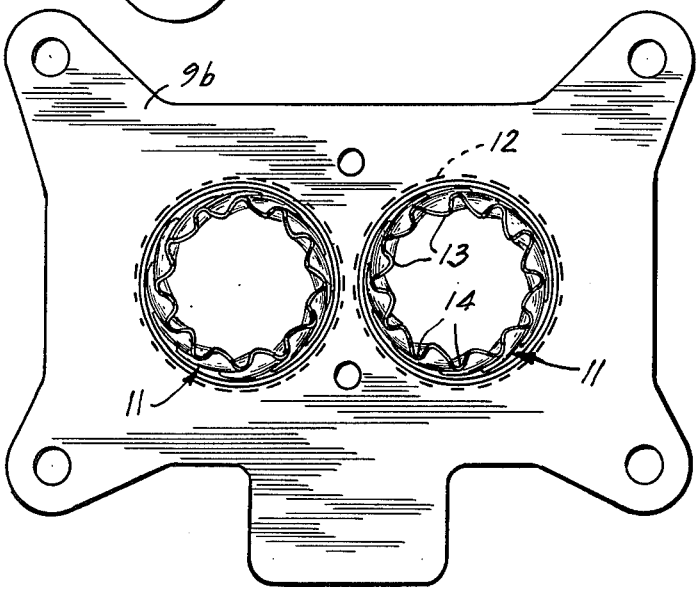
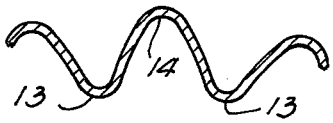
Fig. 4

FUEL VAPORIZING AND MIXING DEVICE FOR GASOLINE ENGINES

BACKGROUND OF THE INVENTION

Over the years, many devices and attachments have been designed for incorporation either as an integral part of a gasoline engine or as an attachment thereto for providing a better vaporization and mixing of the gas-air combustion mixture to provide improved engine operation as well as improved fuel consumption.

Typical devices of this type are those illustrated in the following U.S. Pat. Nos.:

1,396,054; 1,450,550; 1,456,135; 1,869,262; 1,882,966; 1,969,202; 2,028,937; 2,051,556; 2,415,668; 2,498,190; 3,615,296; 3,834,367.

While many of the devices of this type do offer a degree of improvement, the improvement has not been such as to warrant their wide acceptance. Further, many of them undesirably contained moving parts and variously configurated sheet metal fingers and the like which are relatively easily bent and distorted, as well as structures that require an integrated engine design to accommodate the same.

BRIEF SUMMARY OF THE INVENTION

The present invention is directed to an attachment of the type generally described which provides excellent results in the way of improved gas mileage and at the same time provides a very simple one-piece structure which does not require moving parts or a plurality of relatively flimsy diffusing elements or the like. Further the invention enables the production of such a device which may be readily fabricated for any size engine and requires no engine modification or specialized construction to enable its installation, with the resulting structure being exceedingly durable, whereby it may form a permanent part of the engine structure capable of being removed and installed, cleaned, etc, without damage to the device.

The present invention contemplates the utilization of preferably a one-piece tubular sleeve member or the like, provided with means for mounting the same in the intake bore of an engine, with the device providing a more or less venturi-shaped structure having interval rigid intermixing and swirl producing elements which are so proportioned and oriented that a very efficient mixing action may take place without offering any great resistance to the intake flow and thus without creating an impeding action to the in-flow of the gas-air mixture.

At the same time the construction is such that it may be readily fabricated by a series of relatively simple rolling or stamping steps to produce a structure which is quite inexpensive as well as being highly efficient.

In accomplishing these results, the device is constructed in the form of a solid sleeve member having an inlet end which closely approximates the inner diameter of the intake bore of the engine and a discharge end which has an effective area which is less than that of the inlet end, whereby the inner side walls converge slightly in gas flow direction. Suitably formed in the sleeve structure are a plurality of grooves and lands which are so designed that the internal surface of the sleeve member, adjacent the discharge end thereof, has a generally serpentine or corrugated configuration in transverse cross section.

Preferably the bottom of the grooves merge with and are in effect continuations of the tubular side wall of the sleeve member adjacent the inlet end thereof with the lands projecting into the sleeve member. The lands and grooves are so formed that the lands tend to spiral slightly rather than extend in a straight line in the direction of the longitudinal axis of the sleeve member with the leading or inlet end of the lands being rounded, merging into the sleeve side wall and circumferentially offset with respect to the trailing or discharge end of the lands whereby each land has the leading end thereof generally aligned in axial direction with the discharge end of an adjacent land. The lands and grooves may be readily fabricated in the tubular sleeve body by either a rolling operation or a stamping operation, incorporating suitably configurated dies in each case.

Tests have indicated that the inclination or spiraling arrangement of the lands is most effective with an angle of approximately 30° relative to the axial direction of the sleeve and it is believed that this inclination provides a maximum intermixing and swirling action consistent with the inward flow of the gas-air mixture whereby minimum impedance to such flow is created, but at the same time a maximum turbulence is created consistent with most efficient flow. Thus, if the angle is materially decreased the swirling, intermixing action will be correspondingly decreased, and an increase in angle, while theoretically increasing the swirling and thus the intermixing action appears to undesirably oppose or restrict the supply flow of the mixture with a possible decrease in overall efficiency.

In a preferred embodiment of the invention the sleeve or sleeves, assuming dual intake manifold bores, may be readily incorporated with gasket members corresponding with those normally interposed between the carburetor and intake manifold of the engine whereby the device may be readily installed by merely substituting new gasket members incorporating the invention.

BRIEF DESCRIPTION OF THE DRAWINGS

In the drawings wherein like reference characters indicate like or corresponding parts:

FIG. 1 is a vertical section through the top portion of an intake manifold and the adjacent bottom portion of a carburetor, for example, a tube barrel carburetor, illustrating the disposition of a device in accordance with the present invention mounted therein;

FIG. 2 is a bottom plan view of the attachment illustrated in FIG. 1;

FIG. 3 is an enlarged sectional view through a portion of the intake manifold with portions of the present attachment broken away to show details of the invention;

FIG. 4 is an enlarged transverse vertical view through the land-groove structure; and FIG. 5 is a bottom plan view of a similar attachment for a smaller carburetor.

DETAILED DESCRIPTION OF THE INVENTION

Referring to FIG. 1 of the drawings, reference numeral 1 indicates generally a portion of a two-barrel carburetor, i.e., the lower portion thereof, having a mounting flange 2 which is disposed in opposition to the mounting flange 3 of the top portion of an engine intake manifold 4 having intake throats 5. The respective throats 6 of the carburetor are each provided with a butterfly throttle valve 7, by means of which the flow of the air-gas mixture may be effectively controlled. Normally, the valves 7 would be disposed on a common shaft, the dual shaft 8, being illustrated only for explanation purposes.

Disposed between the carburetor flange 2 and the manifold flange 3 is a gasket 9, generally corresponding to the usual type of gasket disposed between such parts in the average engine, usually an asbestos composition type of gasket. In the present instance, a pair of relatively thin gaskets 9*a* and 9*b* are employed which are superimposed upon one another and are provided with aligned openings 10 therein. As illustrated in FIG. 4, disposed in each of the intake throats 5 is a sleeve member indicated generally by the numeral 11 which is of generally tubular configuration and terminates at its upper end as viewed in FIGS. 1 and 4 in an outwardly disposed radially extending flange 12 which is positioned between the respective gasket members 9*a* and 9*b*, and thus effectively secured therebetween in rigid relationship with respect to the associated intake throat 5 and the carburetor throats 6, with each gasket member providing an effective seal between the flange 12 and associated flanges of the carburetor and intake manifold. Preferably, the sleeve members 11 and gaskets 9 are assembled as an integral unit, the gasket members being suitably secured to one another, by adhesive means or the like to form a unitary structure in which the sleeve members are mounted.

As illustrated in FIGS, 2, 3 and 4, the downwardly depending sleeve member 11 is provided on its inner surface with a plurality of lands 13 and alternate grooves 14. In the embodiment of the invention illustrated, the sleeve member 11 preferably is formed from relatively thin sheet metal, for example, of 22 gauge (0.025 inches) in thickness, which is suitably deformed by a rolling or stamping operation in conjunction with suitable die members and the like, to form the desired configuration. However, in some instances it might be desirable or satisfactory to suitably mold or cast the sleeve member whereby the external wall surface thereof may be of smooth cylindrical configuration rather than correspond to the configuration of the internal surface, as in the embodiments illustrated.

It will be particularly noted, from a mechanical standpoint, that with this construction an extremely rigid, strong and durable sleeve structure may be fabricated from comparatively very thin sheet material. Obviously, in structures such as some of those illustrated in the previously referred to patents, employing relatively thin narrow strips, fingers or the like, considerably heavier material must be employed if adequate rigidity is to be incorporated in the elongated strips. At the same time, the structure of the invention adds very little bulk in the intake manifold, with a minimum decrease in the size of the intake throat adjacent the upper end of the sleeve member.

As will be clearly noted from the drawings, particularly FIG. 4, the inner surface of the sleeve member adjacent the lower end thereof has a generally serpentine or corrugated configuration, with the effective area of the sleeve member at the discharge end being somewhat smaller than the area of the sleeve member at the upper end thereof, and thus than the diameter of the throat 5. The structure thus provides a mild venturi action which produces an acceleration in the air mixture flow through the sleeve structure. As will be particularly noted from a reference to FIG. 3, the lands 12 are disposed at an angle with respect to the direction of the axis whereby the land spiral slightly with respect to such longitudinal axis.

I have found that the spiralling of the lands promotes a very efficient swirling action of the flowing gas-air mixture, resulting in very efficient vaporization and intermixing of the gasoline with the incoming air. While beneficial results can be achieved with a land angle of from about 5° to 35°, it would appear that optimum flow and intermixing is achieved with a land angle of approximately 30°. It would appear that as the angle is decreased, the intermixing action relatively decreases, with further increase in the angle over 35° apparently resulting in an impairment in the relative flow, with little or no increase in the desired results.

In the preferred embodiment of the invention, as illustrated in the drawings, the bottom of the grooves 14 merge with a continuation of the inner surface of the upper cylindrical portion of the sleeve member, whereby the maximum diameter of the effective area at the discharge end of the sleeve is only slightly smaller than the diameter of the cylindrical portion thereof.

Extensive tests by independent engineering laboratories made on engines both before and after equiping with the present invention disclose significant improvement in both mileage and exhuast pollution. Thus, such "before and after" tests showed an increase in fuel economy of at least 10%, with significant reductions in hydrocarbon emissions and carbon monoxide emissions.

FIG. 5 illustrates the application of the invention to an attachment for a smaller carburetor, and provided with fewer lands and grooves.

It will be appreciated that the present invention is particularly adapted for simple and easy installation on existing engines and with no moving parts and of very durable construction, has exceedingly long life.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A carburetor attachment for insertion between a carburetor and a cooperable engine intake manifold, comprising a sleeve-like tubular member, formed from relatively thin formable sheet material of tubular configuration, adapted to be inserted in the intake bore of such a manifold, said tubular member having at its inlet end a radially outwardly extending annular flange, of greater diameter than that of such an intake bore for supporting the same therein with such flange disposed between the cooperable mating faces of the carburetor and intake manifold, said tubular member having an external diameter at such end slightly less than that of such a bore, the side walls of said tubular member having a plurality of inwardly directed protuberances forming alternate lands and grooves in the internal surface of said tubular member, the inlet ends of the lands being rounded and merging into the sidewalls of said tubular member adjacent the inlet end thereof, the bottom edges of said grooves being arranged for close disposition to the sidewalls of such an intake bore whereby the effective area at the discharge end is only slightly smaller than that of the intake end, as compared with the total area of such an intake bore, said lands being uniformly spaced and having their respective inlet ends circumferentially offset with respect to their associated outlet ends, forming generally spirally arranged lands with the internal surface of the intermediate portion of said sleeve having a relatively smoothly curved serpentine configuration in transverse cross section, whereby each land is of a generally triangular configuration in transverse cross section, having inwardly converging sidewall portions connected by a convex rounded portion.

2. An attachment according to claim 1, comprising in further combination, a gasket adapted to be disposed between a carburetor and cooperable intake manifold with which said flange is engaged.

3. An attachment according to claim 2, wherein said gasket comprises two gasket members, said flange being disposed between said gasket members and supported thereby.

4. An attachment according to claim 1, wherein said sleeve member is formed from relatively thin sheet metal having a thickness of approximately 22 gauge (0.025 inches).

* * * * *